US007204551B2

(12) United States Patent
Kahan

(10) Patent No.: US 7,204,551 B2
(45) Date of Patent: Apr. 17, 2007

(54) CUSHION HAVING PROTECTIVE SHROUD

(75) Inventor: David L. Kahan, Beachwood, OH (US)

(73) Assignee: Woodard, LLC, Chicago, IL (US)

( * ) Notice: Subject to any disclaimer, the term of this patent is extended or adjusted under 35 U.S.C. 154(b) by 60 days.

(21) Appl. No.: 11/072,730

(22) Filed: Mar. 4, 2005

(65) Prior Publication Data

US 2006/0103185 A1 May 18, 2006

Related U.S. Application Data

(60) Provisional application No. 60/605,595, filed on Aug. 30, 2004, provisional application No. 60/603,127, filed on Aug. 20, 2004.

(51) Int. Cl.
*A47C 31/11* (2006.01)

(52) U.S. Cl. ..... 297/184.11; 297/225; 297/228.11; 297/229; 5/653

(58) Field of Classification Search ..... 297/184.1, 297/184.11, 219.1, 228.11, 229, 228, 225; 5/653, 417–420
See application file for complete search history.

(56) References Cited

U.S. PATENT DOCUMENTS 807,279 A * 12/1905 Kandle ..... 297/222
4,273,380 A * 6/1981 Silvestri ..... 297/188.06
4,600,238 A 7/1986 Goodford
4,725,094 A * 2/1988 Greer ..... 297/229
4,877,288 A * 10/1989 Lee ..... 297/229
5,005,901 A 4/1991 Hinde
5,080,431 A 1/1992 Frazier
5,099,530 A * 3/1992 Scott ..... 5/420
5,150,945 A 9/1992 Aupperlee et al.
5,308,139 A 5/1994 Rieger
5,331,956 A 7/1994 Bailey
5,626,388 A 5/1997 Haltner
5,797,651 A 8/1998 Christa
5,829,828 A 11/1998 Asfaw
5,857,231 A 1/1999 Wade
6,012,770 A 1/2000 Rubin
6,030,034 A * 2/2000 Plohetski ..... 297/188.06
6,086,152 A * 7/2000 Zeller ..... 297/284.5
6,102,463 A 8/2000 Swanson et al.
6,131,995 A 10/2000 Smith
6,155,637 A 12/2000 Waters
6,253,977 B1 7/2001 Greger et al.
6,382,720 B1 5/2002 Franklin et al.
6,428,098 B1 8/2002 Allbaugh
D470,815 S 2/2003 Gates et al.
6,626,491 B1 9/2003 Blome et al.
6,655,736 B1 12/2003 Arenas
6,659,551 B1 12/2003 Arenas
6,676,209 B1 1/2004 Szabo et al.
6,676,210 B1 1/2004 Peyton
6,709,055 B2 3/2004 Gengler et al.

(Continued)

*Primary Examiner*—Peter R. Brown
(74) *Attorney, Agent, or Firm*—Cook, Alex, McFarron, Manzo, Cummings & Mehler, Ltd.

(57) ABSTRACT

A cushion intended for outdoor use includes a pouch or pocket for receiving and preferably concealing the protective shroud. The shroud, when removed from pocket, covers all or substantially all of the cushion. If the cushion is associated with a supporting frame, the shroud may be sized to envelop substantially all of the cushion and the frame. The shroud is made of a material which will protect the cushion from environmental hazards.

27 Claims, 6 Drawing Sheets

U.S. PATENT DOCUMENTS

| | | | | |
|---|---|---|---|---|
| 6,746,069 | B1 | 6/2004 | McKenzie | |
| 2001/0035672 | A1* | 11/2001 | Graff | 297/229 |
| 2004/0016484 | A1 | 1/2004 | Muller | |
| 2004/0016485 | A1 | 1/2004 | Muller | |
| 2004/0075315 | A1 | 4/2004 | Patrick | |
| 2004/0130193 | A1 | 7/2004 | Haller | |

* cited by examiner

CUSHION HAVING PROTECTIVE SHROUD

CROSS REFERENCE TO RELATED APPLICATIONS

This application claims the benefit of the filing dates of U.S. Provisional Application Ser. No. 60/603,127, filed Aug. 20, 2004 and U.S. Provisional Application Ser. No. 60/605,595, filed Aug. 30, 2004.

FIELD OF THE INVENTION

The present invention is directed to cushions especially cushions associated with furniture, including chairs, sofas, loveseats, loungers, benches, stools and the like. A protective shroud is included within or on the cushion in a manner by which the shroud is enclosed and often generally concealed when not in use, and need not be separately stored apart from the cushion. The protective shroud, when deployed, accommodates the size and shape of the cushion and/or furniture as a whole in a manner intended to protect same from detrimental environmental conditions.

BACKGROUND OF THE INVENTION

Cushions often are used in an environment that exposes same to conditions detrimental to the cushion and/or their associated support frame. For example, items of this type can be intended for outdoor use or are suitable for locations which are exposed to the environment. Environmental exposure can include precipitation, wind, sunlight, exposure to contact by plants and animals, and other environmental hazards or influences. Non-limiting examples of same include rain, thunderstorms and hail, each of which can be detrimental to fabrics, and particularly to cushions including padding that will deteriorate upon such exposure. Cushions also typically can be susceptible to damage by animals, either by direct contact with the animal or animal excretions. Of concern is the likelihood of substantial damage to the cushion fabric and cushioning material, as well as a concern that same will be a haven for bacteria, mold, mildew and the like.

References such as Waters U.S. Pat. No. 6,155,637, incorporated by reference hereinto, suggest a slip cover arrangement for chairs such as in glider rockers. This particular patent recognizes the advantage of a multi-layered slip cover which has an upper layer of fabric material and a liner of a moisture-repellant material. It does not provide a location which is a component of the chair and which provides concealing storage for a protective shroud. The slip cover is indicated as being useful for protection from infants, but suitability for use in an outdoor environment or for use and protection against environmental hazards is not specifically indicated.

Blome et al. U.S. Pat. No. 6,626,491, incorporated by reference hereinto, propose a chaise lounge cover and towel as a transportable personal covering. Such contemplates a product made of a towel material such as terry cloth rather than a waterproof or water resistant material. Also, the teaching of this patent is to provide a cover which folds into a pouch to be carried apart from the chaise lounger.

Certain types of cushions are particularly intended for outdoor use. Articles of this type tend to have external material that is resistant or substantially impervious to water and the like. However, these are uncomfortable either when in contact with the skin or due to limited air flow therethrough. Accordingly, it is desirable to have a cushion for outdoor use which does not have to exhibit such a high level of water resistance as to create user discomfort.

SUMMARY OF THE INVENTION

The present invention is directed to cushions and is especially useful for cushions intended for outdoor use. The cushion itself includes a permanent pouch or pocket location which preferably is not fully detachable from the portion of the unit to which it is secured and preferably provides a concealing function. A shroud having protective characteristics is provided in a form such that it covers all or substantially all of the cushion, or the cushion and its associated support frame, while at the same time being capable of readily collapsing or folding to a size suitable for fitting within the pouch or pocket. The shroud is made of a material which will protect the cushion from environmental hazards. The shroud substantially covers the surfaces needing protection from the environment.

It is accordingly a general aspect or object of this invention to provide an improved cushion with protective shroud provided as a unitary product for sale to consumers.

Another aspect or object of the invention is to provide cushions and/or cushioned furniture which include a non-detachable pouch or pocket within which is stored a weather-protective shroud that is large enough to substantially fully encapsulate the cushion components and/or its associated support frame.

Another aspect or object of this invention is that a weather-protective shroud is provided in a permanent, accessible location of a cushion, whereby a user can quickly remove the shroud, open it up, and place it over the surfaces which otherwise would be damaged or rendered unsuitable for use for a considerable time.

Other aspects, objects and advantages of the present invention will be understood from the following description according to the preferred embodiments of the present invention, specifically including stated and unstated combinations of the various features which are described herein, relevant information concerning which is shown in the accompanying drawing.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
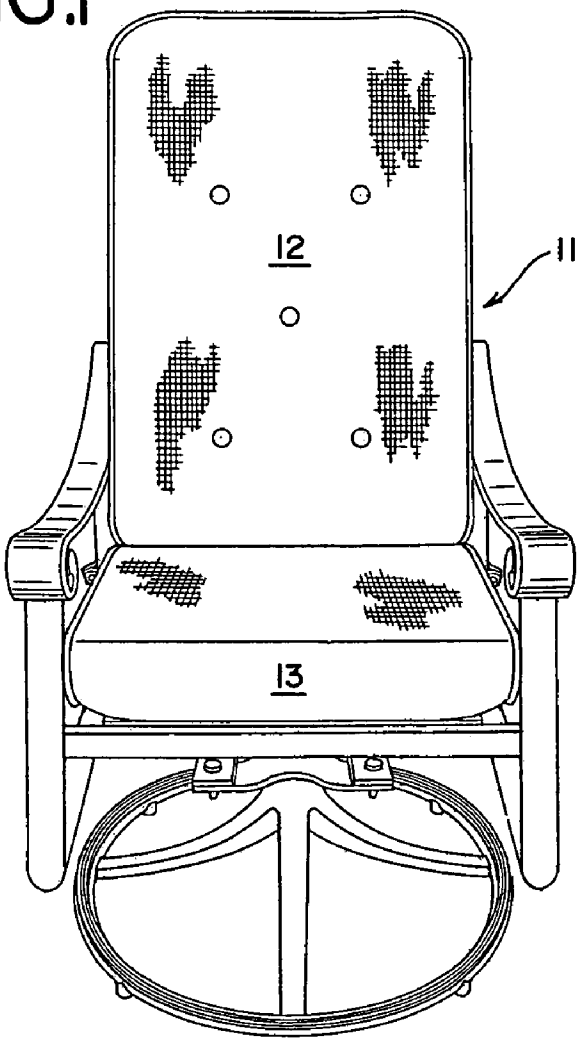
FIG. 1 is a perspective view of a cushioned chair of the type suitable for the present invention.

A chair, generally designated by reference numeral 11, is illustrated in FIG. 1. This particular chair has multiple cushions 12 and 13. It will be appreciated that the invention also is suitable for many other types of furniture or equipment, specifically including cushions per se, which can be moveable, and which are used as seating or supporting surfaces which provide a comfortable feel.

Figure 2:
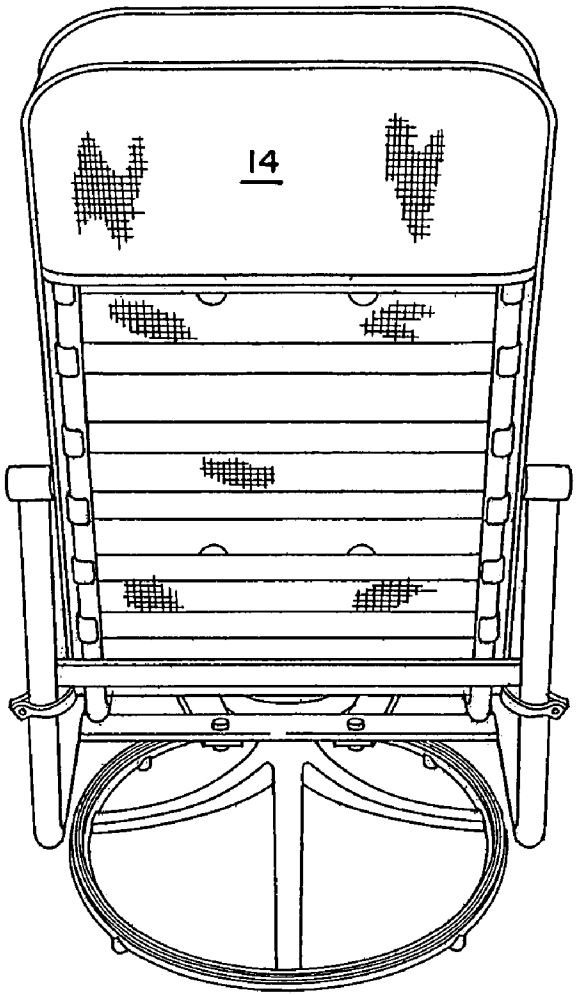
FIG. 2 is an elevational rear view of a chair as illustrated in FIG. 1.

FIG. 2 illustrates a pouch or pocket which is in a preferred arrangement of an attached component that is not intended to be removable from the cushion or chair. The illustrated pouch or pocket 14 is shown in this view at a location in the upper part of the back side cushion 12, with the pocket being sized to receive the upper portion of the backrest of the chair so as to secure the cushion thereto. Other suitable arrangements are possible. These include having the pouch or pocket area be on the front side of the cushion, thereby providing a pillow-like element. Another embodiment positions the pouch more toward the lower portion of the cushion 12 in order to provide lumbar support, for example. The further embodiment provides the pouch area at a location on the underside of the cushion 13.

Figure 4:
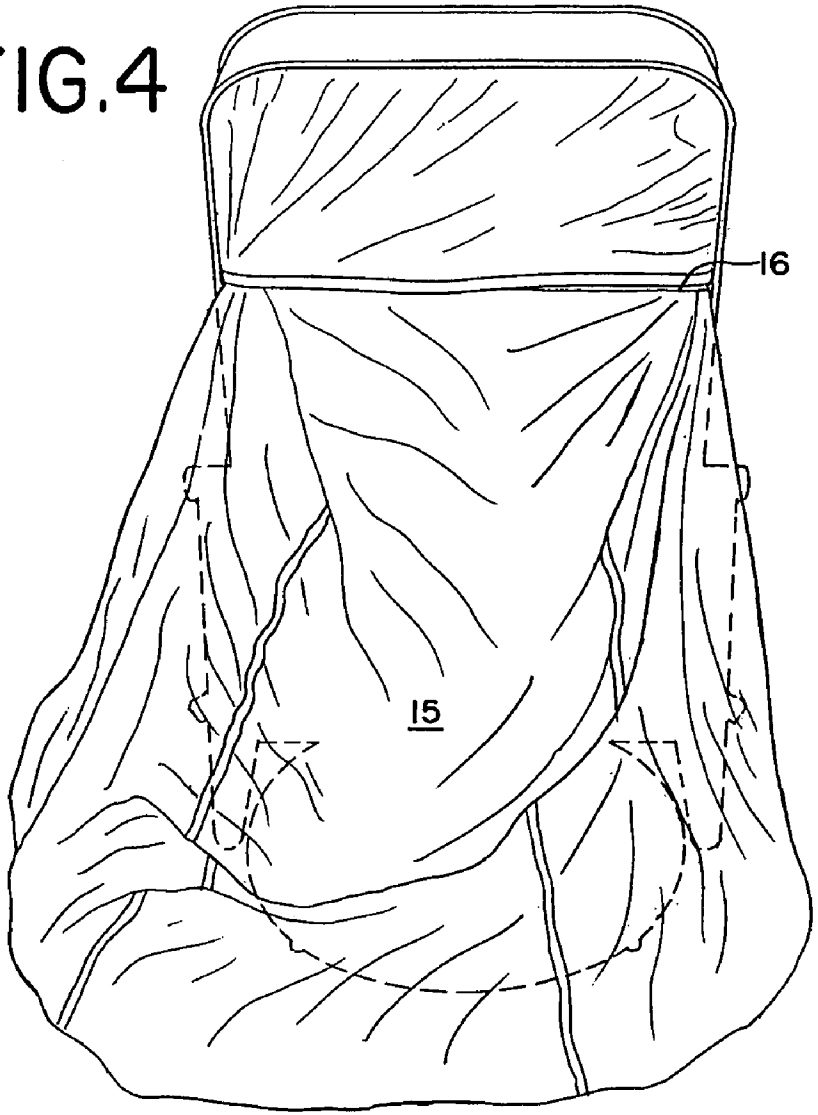
FIG. 4 is a perspective view showing the shroud substantially fully removed from the pocket and prior to its deployment into a protective orientation.
Figure 3:
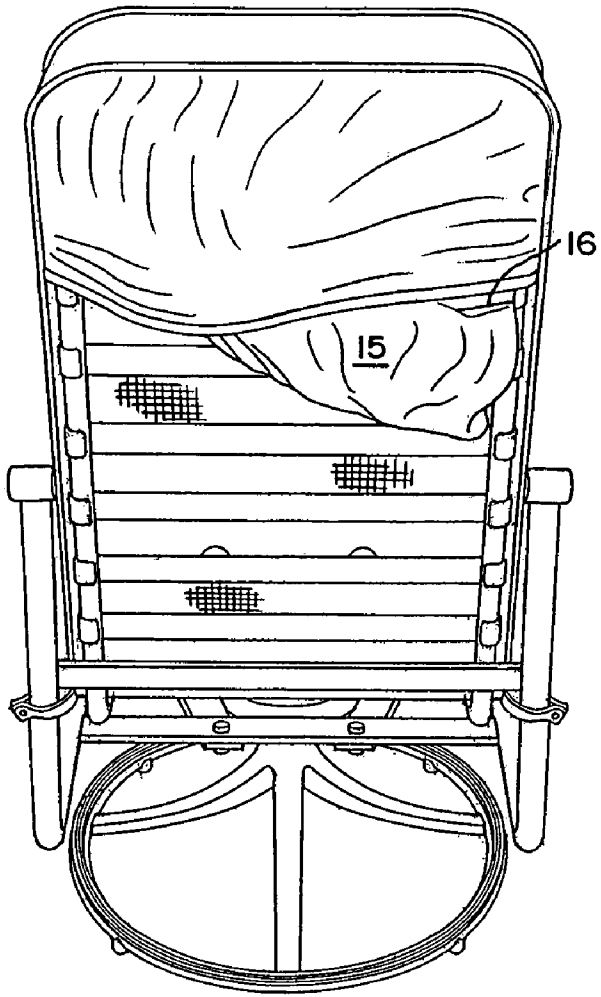
FIG. 3 is a detail view similar to FIG. 2 and illustrating a shroud component in the process of being removed from a pocket.

Wherever the pouch is located, it is sized, shaped and positioned to readily accommodate a protective shroud member 15, as illustrated in FIG. 3. As can be seen in FIG. 3 and FIG. 4, it is preferred that the protective shroud 15 be itself secured to or integral with the cushion or furniture, such as at location 16, at least partially visible in FIG. 3 and FIG. 4.

The protective shroud 15 is made of a material, preferably of a lightweight type, which prevents or at least significantly retards the penetration of moisture or other undesirable environmental elements therethrough. The result is protection of whatever is positioned therebeneath. Materials include so-called waterproof or water protective nylon, GORTEX®, polytetrafluoroethylene materials of this general type, TYVEK® protective material, vinyl material, and other suitable protective materials. The shroud preferably is breathable as well as lightweight.

Shrouds having properties such as these are to be suitable for collapsing or folding into a volume as provided by the pouch or pocket, which conceals same when not in use. In addition, the shroud, when unfurled or deployed, will substantially or fully cover the chair, cushion or other item of the unit which needs to be protected.

Figure 6:
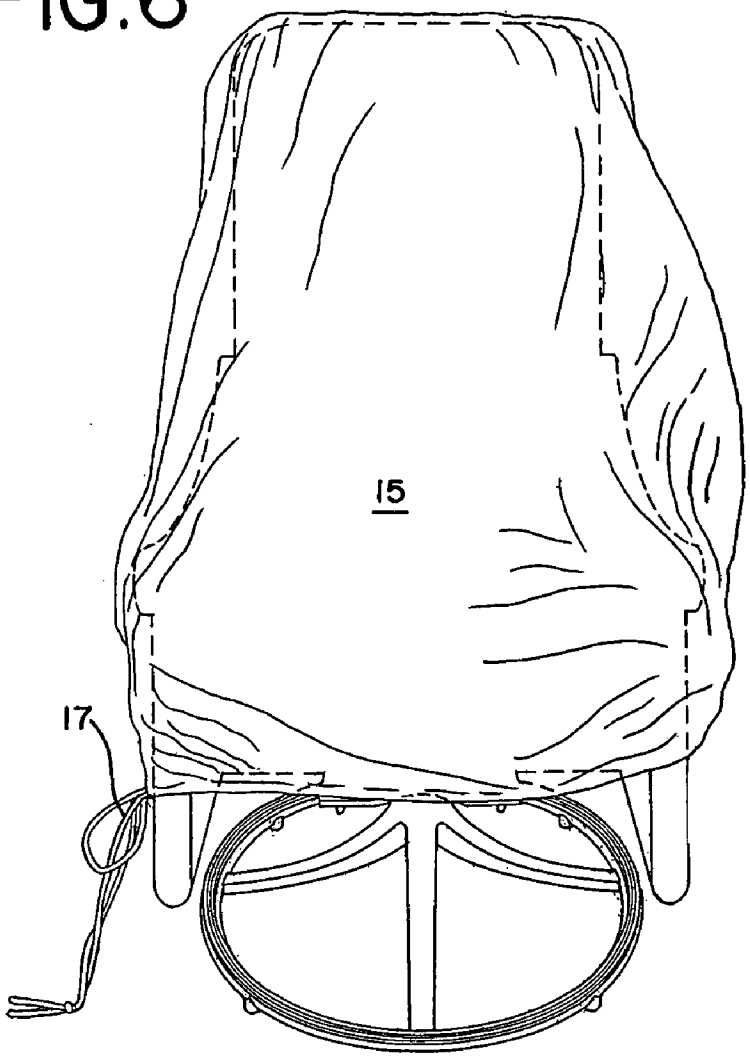
FIG. 6 shows the shroud in full deployment over the chair.
Figure 5:
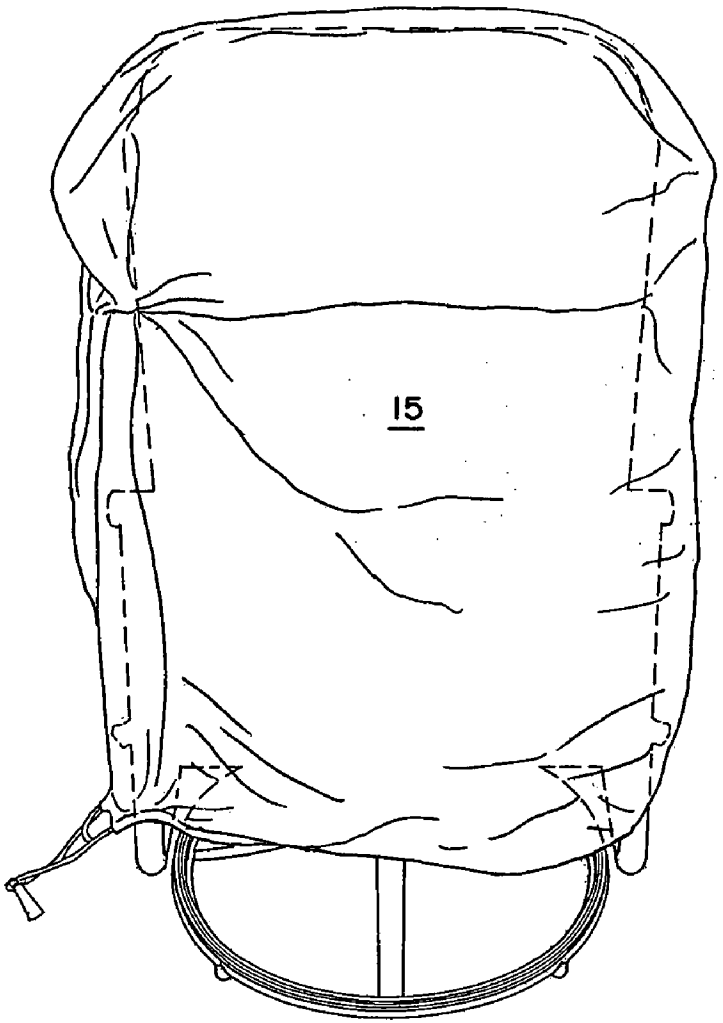
FIG. 5 illustrates deployment in progress of the shroud.

With more particular reference to the location 16 and the size and shape of the shroud 15, these elements of the illustrated embodiment are further evident from FIGS. 5 and 6. FIG. 5 illustrates movement of the shroud from the substantially fully unfurled orientation of FIG. 4 to a substantially protective deployed orientation shown in FIG. 5. In moving between these orientations, the user pulls at least a portion of the shroud 15 over the top of the cushion, while another portion of the shroud remains over the back of the cushion. FIG. 6 illustrates a substantially fully deployed orientation of the shroud 15. FIG. 6 also illustrates an optional, preferred arrangement wherein a securement member 17 is exposed during deployment in order to help retain the deployed shroud in its proper protective position. The illustrated securement member is a double draw-string of generally known construction.

It will be appreciated that, with this arrangement, the item to be protected has the protective shroud secured to it as a generally permanent component thereof. This shroud has the ability to move from its stowed location such as evident from FIG. 2 and FIG. 3. The shroud further has the capability of unfurling to a size and shape which neatly and closely provides a protective barrier for the item itself. With such an arrangement, the cushions can be made of comfortable and very breathable materials which are especially suitable for contact with the skin while at the same time having the capability to quickly and surely have a member deployed over the comfortable yet vulnerable cushion surfaces without having to be concerned about locating same, such as in the event of a rapidly approaching rainstorm.

Figure 7:
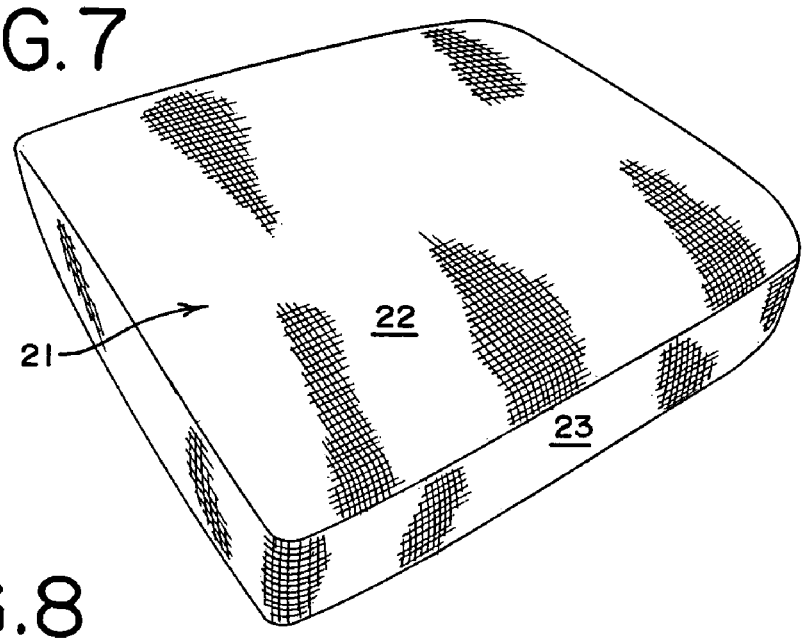
FIG. 7 is a perspective view of a cushion of the type suitable for the present invention.

In another embodiment of the invention, a cushion, generally designated by reference numeral 21, is illustrated in FIG. 7. This particular cushion has a top surface 22 and a side end or edge 23. It will be appreciated that the invention also is suitable for many other types of cushions, which can be moveable, and which are used as seating or supporting surfaces that provide a comfortable feel and need not be especially water resistant.

Figure 8:
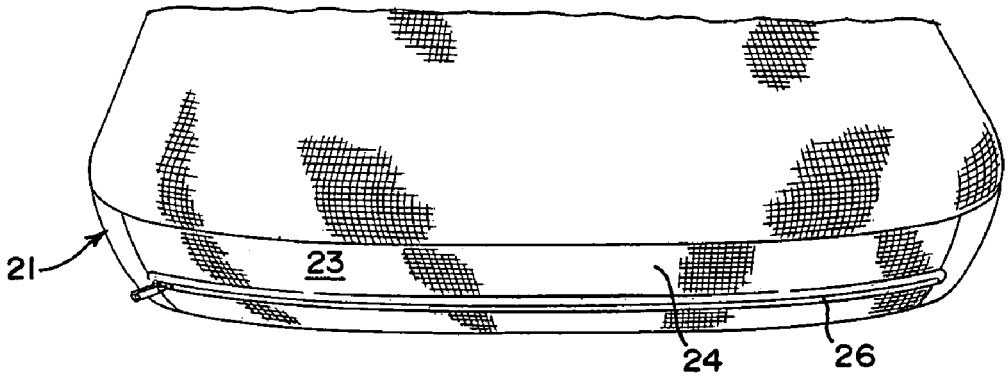
FIG. 8 is a perspective rear view of a cushion as illustrated in FIG. 7, showing the exterior of a pouch or pocket along an edge of the cushion.

FIG. 8 illustrates the cushion having a pouch or pocket which is in a preferred arrangement of an attached component that is not intended to be removable from the cushion. The illustrated pouch or pocket 24 is shown in this view at a location in the back edge or end 23 of the cushion 21. Other suitable arrangements are possible. These include having the pouch or pocket area be on the side edge of the cushion, or along its bottom surface in order to provide the pouch area at a location on the underside of the cushion 21.

Figure 9:
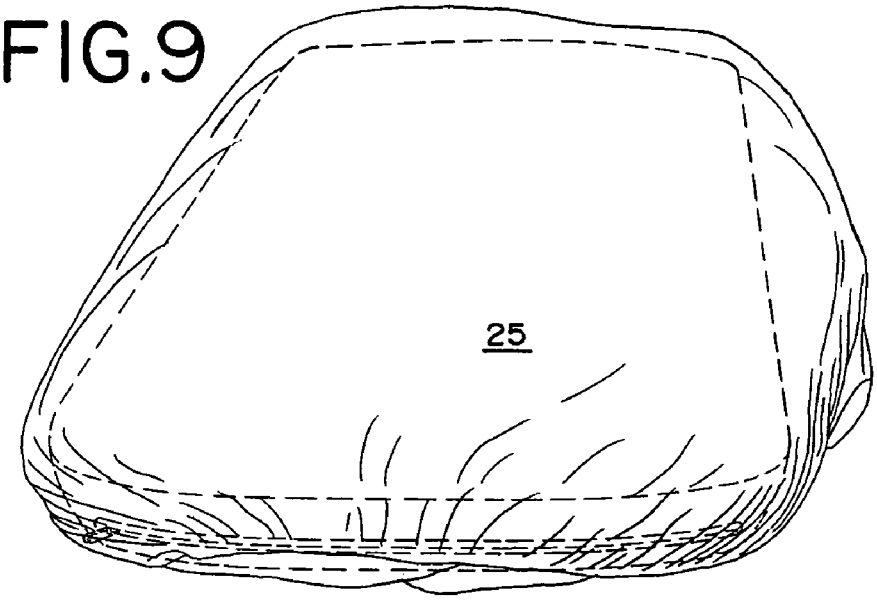
FIG. 9 is a perspective view similar to FIG. 7 and illustrating a shroud component after having been removed from the pouch pocket and pulled over the cushion to provide integral protection of the cushion.

Wherever the pouch is located, it is sized, shaped and positioned to readily accommodate a protective shroud member 25, as illustrated in FIG. 9. It is preferred that the protective shroud 25 be itself secured to or integral with the cushion, such as at a location accessible by opening a zipper 26, or other closure arrangement such as hook and loop material, gussets, pleated locations, snaps, buttons and so forth. The integral connection is typically achieved by sewing, heat welding, ultrasonic action, or actinic type energy application.

Figure 10:
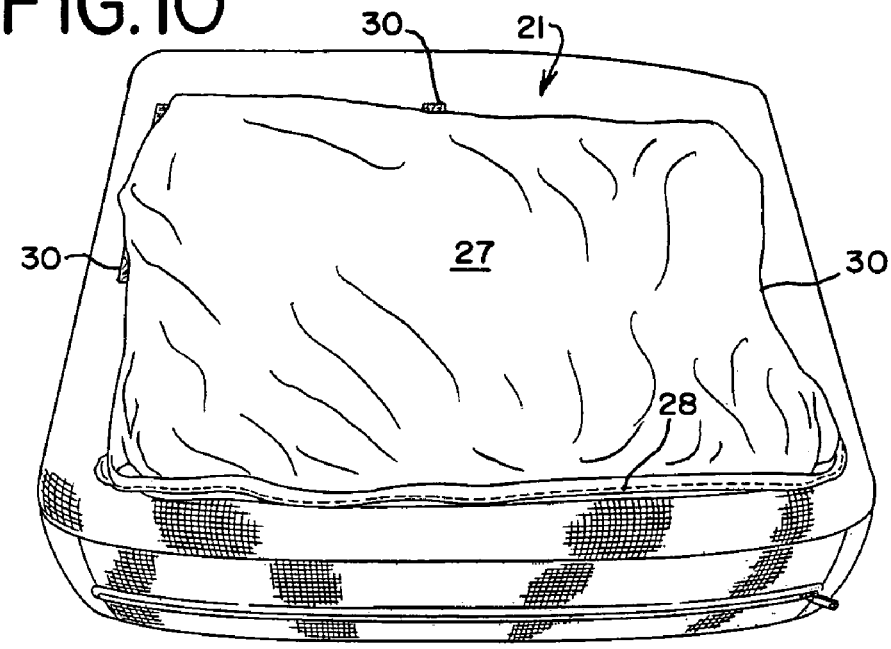
FIG. 10 is a perspective view showing another embodiment having a pouch or pocket on a major surface thereof, showing a stored condition.

With more particular reference to the securement, size and shape of the shroud 25, these elements of the illustrated embodiment are further evident from FIG. 9 and FIG. 10 for another embodiment. FIGS. 10–13 illustrate an embodiment where the shroud 25 is on the cushion underside. This shows the substantially fully folded and stored orientation of FIG. 10 to a substantially protective deployed orientation shown in FIG. 13. In moving between these orientations, the user pulls at least a portion of the shroud 25 over the top of the cushion, while another portion of the shroud remains over the back of the cushion.

Figure 11:
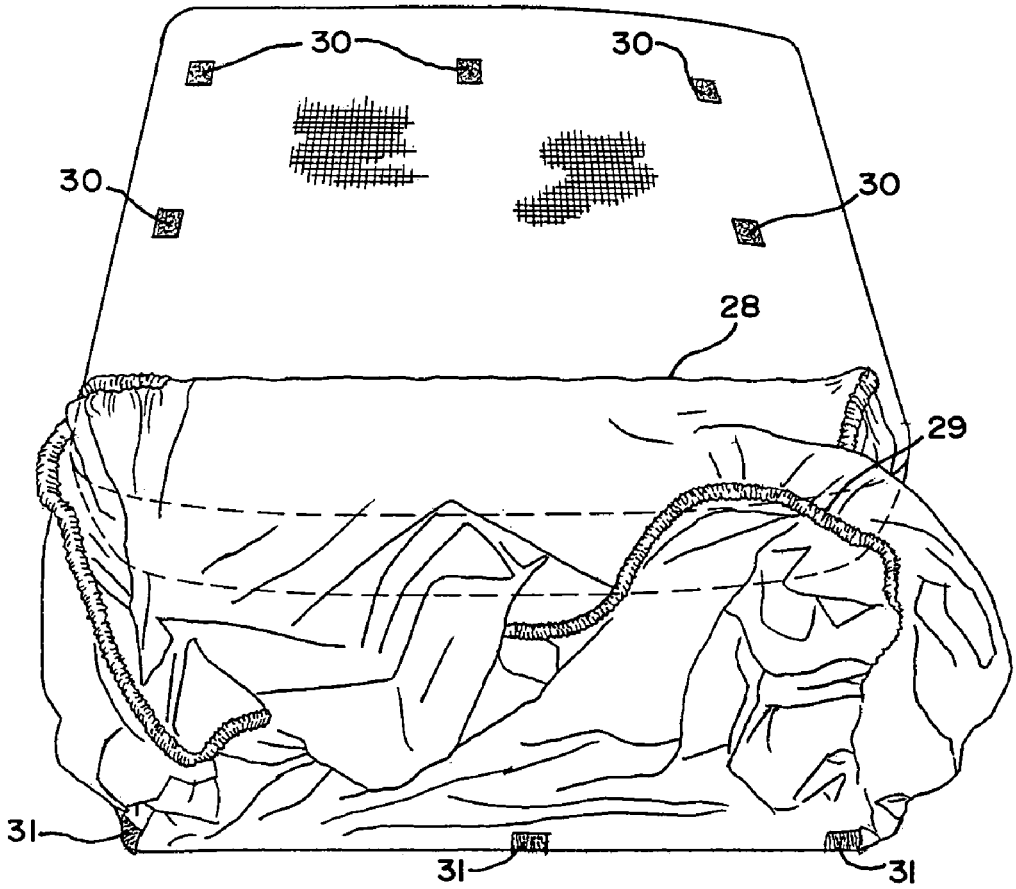
FIG. 11 illustrates deployment in progress of the shroud of FIG. 10.
Figure 13:
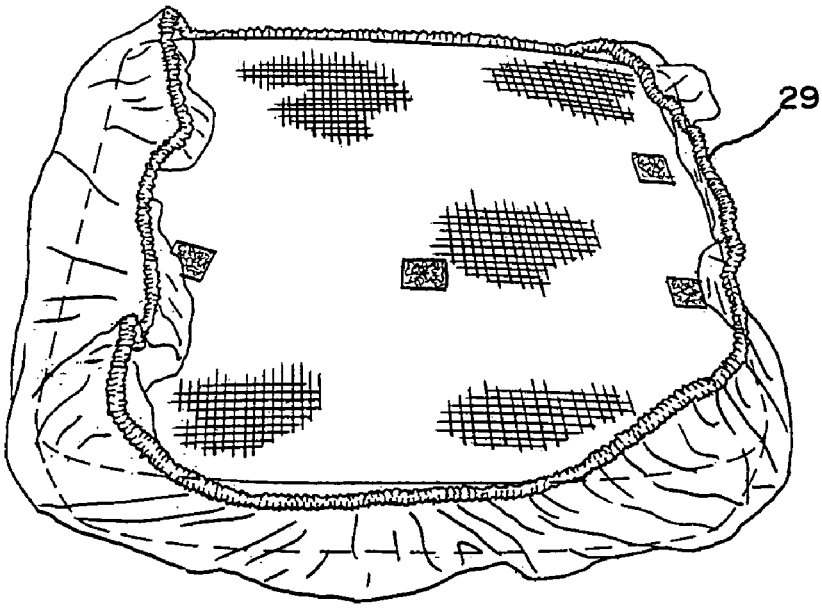
FIG. 13 shows the shroud of FIG. 10 with same moving toward covering the bottom surface of the cushion from which the shroud originated in full storage mode.

FIG. 11 illustrates the shroud fully out of a pocket 27 which is formed from the shroud 25 itself. Securement location 28 maintains connection between the shroud 25 and the cushion 21. FIG. 13 also illustrates an optional, preferred arrangement wherein a securement member 29, such as the strapping shown, is exposed during deployment in order to help retain the deployed shroud in its proper protective position. The illustrated securement member is an elastomeric band of generally known construction.

Figure 12:
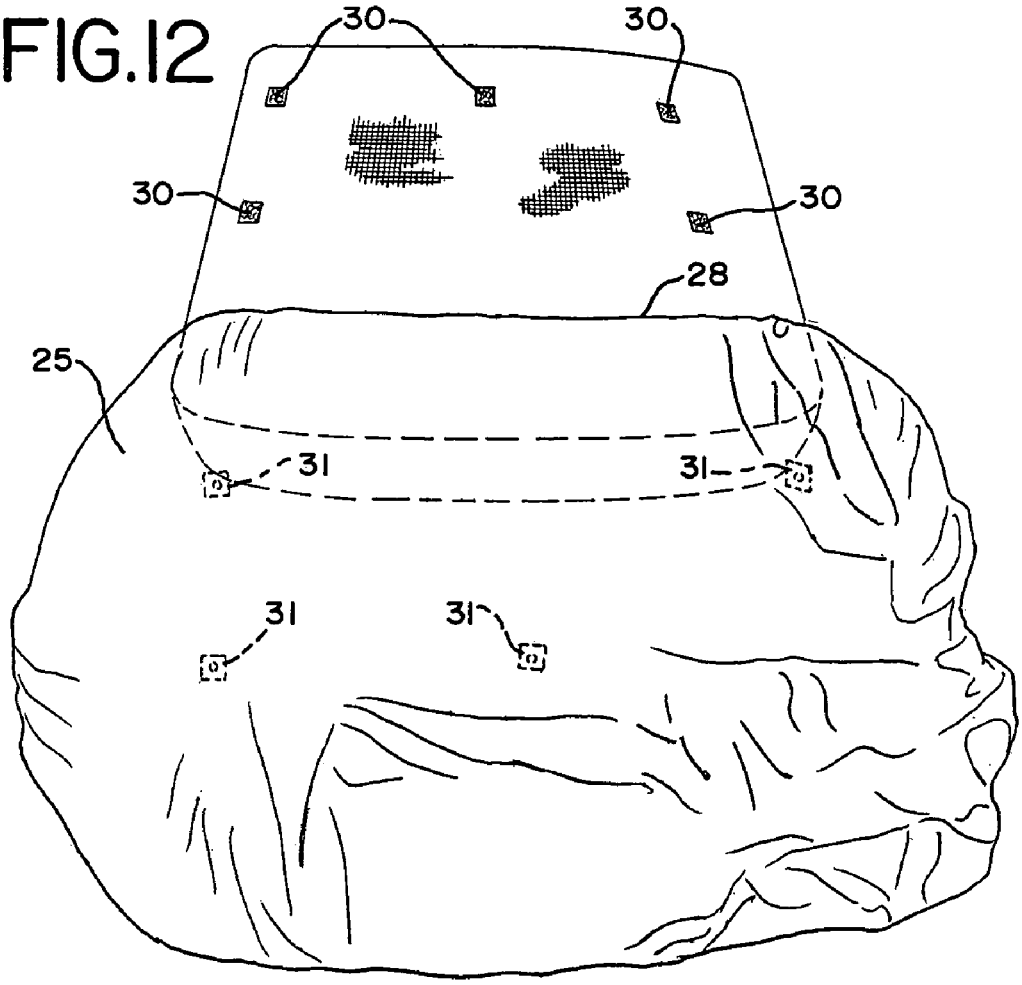
FIG. 12 shows the shroud in the course toward further progress in deployment over the cushion.

FIGS. 10, 11 and 12 further illustrate the approach by which the pocket or pouch 27 is formed from the shroud itself. Firstly, substantially permanent securement is provided at 28, such as by stitching, heat welding and so forth. The shroud material is releasably secured to the cushion 21 by one or more selective connection members 30, such as hook and loop material, snaps, hooks and eyelets, buttons, zippers and the like. Each selective connection member is positioned on both the shroud and the cushion such that the shroud is folded and shaped into a pocket or pouch 27. This arrangement is evident from FIG. 12 wherein a cushion location for the selective connection members 30 is shown on the cushion face. Corresponding attachment locations 31 show where pocket formation is found on the shroud. When the shroud is again formed into the pocket or pouch, the bulk of the shroud material is folded onto itself while attachment locations 31 remain available for resecurement with the respective selective connection members 30.

The substantially permanent securement is of particular advantage in facilitating action for folding the shroud itself. This arrangement provides stability to one edge of the shroud. Then the user can more easily manipulate, such as by folding and/or rolling, the shroud onto itself and into the pocket. A solid working base position is provided to the shroud which enables a single person to handle the rest of the shroud to position it as needed.

In another embodiment, members can be provided to also assist in folding of the shroud. These include elongated tabs along the side edges of the shroud which can be grasped in order to size the width and/or to better control manipulation or positioning of the shroud prior to folding or rolling same and insertion into the pocket.

It will be appreciated that, with this arrangement, the item to be protected has the protective shroud secured to it as a generally permanent component thereof. This shroud has the ability to move from its stowed location such as evident from FIG. 8 and FIG. 10. The shroud further has the capability of unfurling to a size and shape which neatly and closely provides a protective barrier for the item itself. With such an arrangement, the cushions can be made of comfortable and very breathable materials which are especially suitable for contact with the skin while at the same time having the capability to quickly and surely have a member deployed over the comfortable yet vulnerable cushion surfaces without having to be concerned about locating the same, such as in the event of a rapidly approaching rainstorm.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein.

What is claimed:

1. A furniture item suited for outdoor use comprising:
a frame;
a cushion removably associated with the frame;
a covering material for the removable cushion; and
a shroud secured to the covering for the cushion comprising a protective material sized when unfurled to substantially envelop both the cushion and the frame.

2. The outdoor furniture item of claim 1 wherein the cushion is maintained in position on the frame by a pocket associated with the cushion covering, the pocket receiving a portion of the frame and being adapted to receive the shroud.

3. The outdoor furniture item of claim 1 wherein the covering for the cushion includes a pocket associated therewith for receiving the shroud, the pocket being secured to the cushion covering such that access to the pocket requires removing the cushion from the frame.

4. The outdoor furniture item of claim 3 wherein the pocket is secured to an edge of the cushion covering.

5. The outdoor furniture item according to claim 3 wherein the pocket is secured to a bottom surface of the cushion covering.

6. The outdoor furniture item of claim 3 wherein the shroud is permanently secured to the pocket.

7. The outdoor furniture item of claim 1 wherein the covering for the cushion has an opening closed by a fastener, the covering sized to receive the shroud on the inside thereof for storage.

8. The outdoor furniture item of claim 7 wherein the shroud is secured to an inside surface of the cushion covering.

9. The outdoor furniture item of claim 1 wherein the shroud includes a drawstring for securing the shroud, when unfurled, to the furniture item.

10. The outdoor furniture item of claim 1 wherein the shroud includes an elastic material for securing the shroud, when unfurled, to the furniture item.

11. The outdoor furniture item of claim 1 wherein the shroud is permanently secured to the cushion covering.

12. The outdoor furniture item of claim 11 wherein the shroud is permanently secured to the cushion covering adjacent one edge thereof and is removably secured to the cushion covering adjacent one or more other edges thereof.

13. The outdoor furniture item of claim 1 wherein the cushion and shroud have complimentary selective connection members and attachment locations whereby, when the connection members are secured to the attachment locations, a pocket is formed by a first portion of the shroud and the cushion covering for receiving a second portion of the shroud, for the storage thereof.

14. A cushion and shroud combination, comprising:
a cushion component which is vulnerable to negative impact by environmental conditions;
a pocket component associated with and in close relationship to the cushion component;
a shroud member including protective material, said shroud member being secured to the cushion component in the vicinity of said pocket component; and
said shroud member being substantially fully accommodated by the pocket component when the shroud member is in a stored condition, and said shroud member being sized and shaped to envelop at least a substantial portion of said cushion component during a deployed orientation of said shroud member, the shroud member including a drawstring for securing the shroud member, when unfurled, to the cushion component.

15. The combination of claim 14 wherein the pocket component is secured to an edge of the cushion component.

16. The combination of claim 14 wherein the pocket component is secured to a bottom surface of the cushion component.

17. The combination of claim 14 wherein the cushion component comprises a covering and the covering has an opening closed by a fastener through which access to the pocket is obtained, the covering being sized to receive through the opening the shroud member for storage.

18. The combination of claim 17 wherein the shroud member is secured to an inside surface of the cushion covering.

19. The combination of claim 17 wherein the shroud member is permanently secured to the covering of the cushion component.

20. The combination of claim 19 wherein the shroud member is permanently secured to the cushion component adjacent one edge thereof and is removably secured to the cushion component adjacent one or more other edges thereof.

21. The combination of claim 14 wherein the shroud member includes an elastic material for securing the shroud member, when unfurled, to the cushion component.

22. The combination of claim 14 wherein the shroud member is permanently secured to the pocket component.

23. The combination of claim 14 wherein the cushion component and shroud member have complimentary selective connection members and attachment locations whereby, when the connection members are secured to the attachment locations, the pocket component is formed by a first portion of the shroud member and the cushion component for receiving a second portion of the shroud member, for the storage thereof.

24. A furniture item suited for outdoor use comprising;

a frame;

a cushion removably associated with the frame;

a covering material for the removable cushion; and a shroud permanently secured to the covering material for the cushion adjacent one edge thereof and is removably secured to the cushion covering material adjacent one or more other edges thereof, the covering material comprising a protective material sized when unfurled to substantially envelop the cushion.

25. A furniture item suited for outdoor use comprising:

a frame;

a cushion removably associated with the frame;

a covering material for the removable cushion; and a shroud secured to the covering for the cushion comprising a protective material sized when unfurled to substantially envelop the cushion, the cushion covering and shroud having complimentary selective connection members and attachment locations whereby, when the connection members are secured to the attachment locations, a pocket is formed by a first portion of the shroud and the cushion covering for receiving a second portion of the shroud, for the storage thereof.

26. A cushion and shroud combination, comprising:

a cushion component which is vulnerable to negative impact by environmental conditions;

a pocket component associated with and in close relationship to the cushion component;

a shroud member including protective material, said shroud member being permanently secured to the cushion component in the vicinity of said pocket component adjacent one edge thereof and is removably secured to the cushion component adjacent one or more other edges thereof; and said shroud member being substantially fully accommodated by the pocket component when the shroud member is in a stored condition, and said shroud member being sized and shaped to envelop at least a substantial portion of said cushion component during a deployed orientation of said shroud member.

27. A cushion and shroud combination, comprising:

a cushion component which is vulnerable to negative impact by environmental conditions;

a pocket component associated with and in close relationship to the cushion component;

a shroud member including protective material, said shroud member being secured to the cushion component in the vicinity of said pocket component; and said shroud member being substantially fully accommodated by the pocket component when the shroud member is in a stored condition, and said shroud member being sized and shaped to envelop at least a substantial portion of said cushion component during a deployed orientation of said shroud member, the cushion component and shroud member having complimentary selective connection members and attachment locations whereby, when the connection members are secured to the attachment locations, the pocket component is formed by a first portion of the shroud member and the cushion component for receiving a second portion of the shroud member, for the storage thereof.

* * * * *